United States Patent [19]

Sayles

[11] 3,953,259

[45] Apr. 27, 1976

[54] PRESSURE EXPONENT SUPPRESSANTS

[75] Inventor: David C. Sayles, Huntsville, Ala.

[73] Assignee: The United States of America as represented by the Secretary of the Army, Washington, D.C.

[22] Filed: Sept. 1, 1970

[21] Appl. No.: 78,332

[52] U.S. Cl. ..... 149/19.5; 149/19.6; 149/20; 149/76; 149/92; 149/105; 149/108.2

[51] Int. Cl.[2] ..... C06B 45/10; C06B 45/8; C06B 25/34; C06B 25/4

[58] Field of Search ..... 149/92, 105, 19, 20, 149/19.5, 19.6, 108.2, 76

[56] References Cited

UNITED STATES PATENTS 3,321,341 5/1967 Ottoson ..... 149/92 X

*Primary Examiner*—Leland A. Sebastian
*Assistant Examiner*—Donald P. Walsh
*Attorney, Agent, or Firm*—Nathan Edelberg; Robert P. Gibson; James T. Deaton

[57] ABSTRACT

The use of certain chemical constituents, such as hexanitrostilbene, triaminotrinitrobenzene, picric acid and the ammonium salt of picric acid, which can be incorporated into propellant compositions which have high pressure exponents to reduce them to acceptable values. The propellant compositions generally include a binder, a curing agent, oxidizer ingredients, and other additives which depend upon the specific structure of a particular propellant formulation.

10 Claims, 1 Drawing Figure

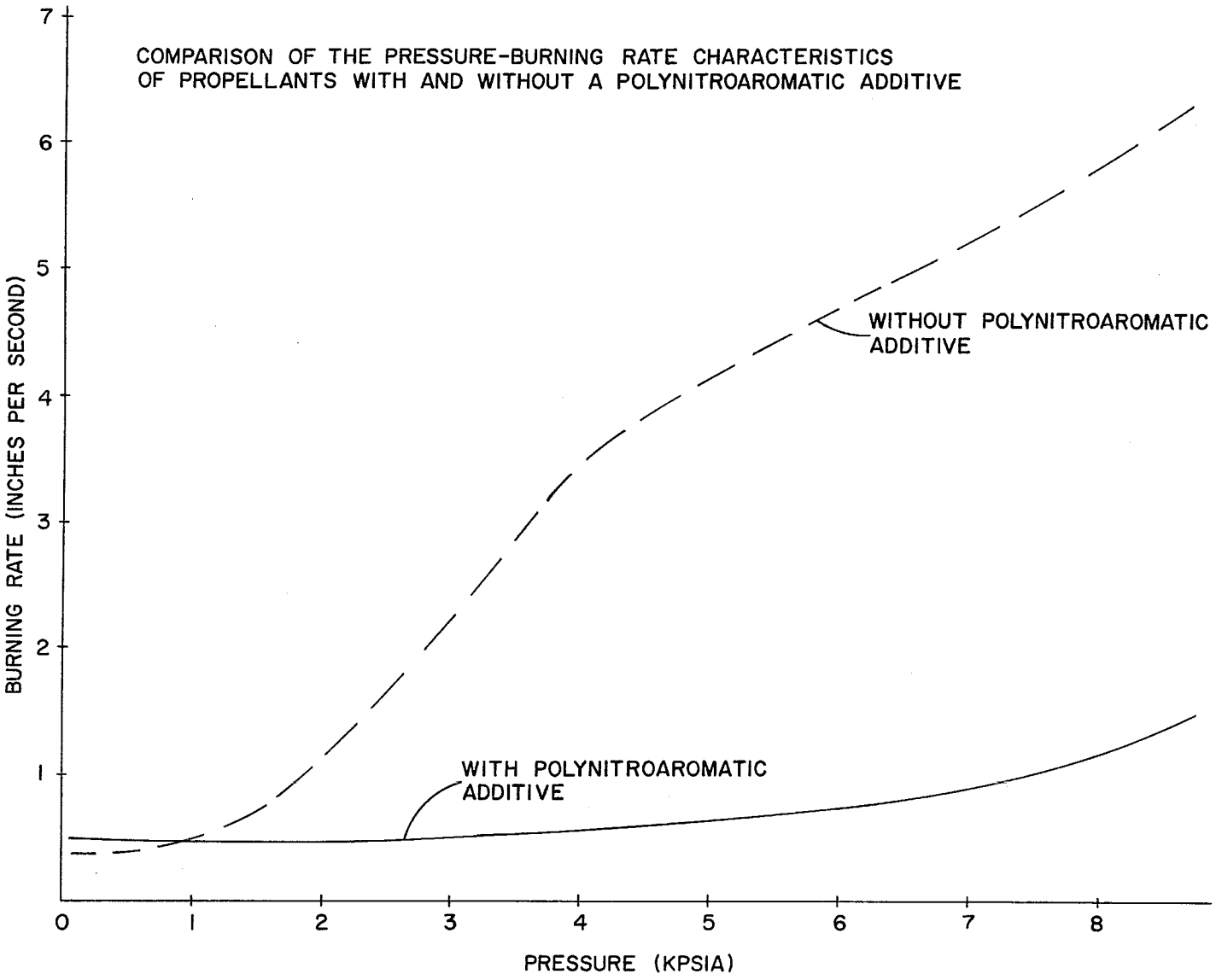
David C. Sayles,
INVENTOR.
BY Harry M. Lorogovitz
Edward J. Kelly
Herbert Berl
James T. Deaton

PRESSURE EXPONENT SUPPRESSANTS

BACKGROUND OF THE INVENTION

The pressure exponent (n) of a propellant is a measure of the increase in burning rate of a propellant which occurs as the chamber pressure is increased. The pressure exponent (n) is the tangent to the curve which can be drawn when the burning rate is plotted against chamber pressure. The pressure exponent would be zero for a propellant whose burning rate is totally independent of pressure.

A pressure exponent of less than 0.5 is necessary for a propellant to be acceptable for use in propulsion subsystems. The exception is pressure-sensitive propellants which are intended for use in controllable motors. Considering the smokeless NF-propellant, as an illustration, it has been necessary to resort to the use of a mixture of ammonium perchlorate (20%) and HMX (cyclotetramethylenetetranitroamine) as oxidizer to result in a propellant with a pressure exponent approaching 0.5. The replacement of a portion of the HMX oxidizer with ammonium perchlorate lowered the pressure exponent of the propellant from 0.8 to a value of 0.6. Accordingly, it can be seen that there is a need for materials that can be used in propellant compositions to lower the pressure exponent thereof.

Therefore, it is an object of this invention to provide chemical constituents that can be used in propellant compositions to lower the pressure exponent of the propellant.

Another object of this invention is to provide pressure exponent suppressants that can be substituted for ammonium perchlorate in smokeless type propellants.

A further object of this invention is to provide pressure exponent suppressants that can be added in small quantities, say from 1 to 5 percent by weight, to presently known propellant compositions to lower the pressure exponents thereof to an acceptable level for a specific use.

SUMMARY OF THE INVENTION

In accordance with this invention, polynitrosubstituted aromatic chemicals such as hexanitrostilbene, triaminotrinitrobenzene, picric acid and its ammonium salt are provided to be used in propellant compositions containing other ingredients such as plasticizer, binder, oxidizer, and other additive ingredients to have the pressure exponent of the particular propellant composition reduced to an acceptable value due to the presence of the polynitroaromatic chemical.

BRIEF DESCRIPTION OF THE DRAWING

The Single FIGURE of the drawing is a graph showing burning rate versus pressure of a propellant with and without a polynitroaromatic additive.

DETAILED DESCRIPTION OF THE INVENTION

The polynitrosubstituted aromatic compounds selected from hexanitrostilbene, triaminotrinitrobenzene, picric acid and the ammonium salt of picric acid are particularly effective in reducing the pressure exponent. Generally speaking, these chemicals can be incorporated in propellant compositions from about 1 to 25 percent by weight of the propellant composition to lower the pressure exponent. For example, in smokeless NF-propellant when ammonium perchlorate is replaced with 20 to 21 weight percent of one of the above listed polynitrosubstituted aromatic compounds, the pressure exponent is effectively reduced. In other conventional propellants, such as composite or double base propellants, the addition of 1 to 5 percent by weight of one of the polynitrosubstituted aromatic compounds functions effectively in reducing the pressure exponent over an operating range between 500 and 10,000 psia without adversely affecting performance of the particular propellant. The inclusion of polynitrosubstituted aromatic compounds in considerably higher proportions results in some reduction in performance with little effect on burning rate.

These polynitrosubstituted aromatic compounds have been assessed as partial replacements for ammonium perchlorate, as illustrated in the table below, but they can also be used as a partial replacement for HMX, instead of the ammonium perchlorate, with little or no adverse effect on performance and still produce the desired effect as the pressure exponent. Apparently, the polynitrosubstituted aromatic compounds function to desensitize the combustion zone to the changes of heat transfer associated with pressure. When the polynitrosubstituted aromatic compounds are substituted for ammonium perchlorate, they produce an additional beneficial effect, namely, increased smokelessness. That is, the formation of hydrogen chloride as a combustion product does not result, and therefore, the exhaust products contain less smoke - producing constituents.

The pressure exponent suppressant, hexanitrostilbene, when used as a replacement for ammonium perchlorate, in a NF-propellant of the smokeless type is illustrated in Table I, Composition B, and Table II shows the burning rates resulting from the propellants of Compositions A and B in Table I when tested in a Crawford Strand Burner.

TABLE I

COMPARISON OF NF-PROPELLANTS CONTAINING DIFFERENT PRESSURE EXPONENT DEPRESSANTS

| Propellant Ingredient | Composition A RH-U-106 | Composition B |
|---|---|---|
| Ethyl Acrylate/Acrylic Acid Copolymer | 4.8 | 4.8 |
| TVOPA[1] | 24.5 | 24.5 |
| HMX | 50.5 | 50.5 |
| Hexanitrostilbene | — | 20.2 |
| Ammonium Perchlorate | 20.2 | — |
| Carbon Black (Added) | 0.5 | 0.5 |
| UNOX 221 (Added)[2] | 1.0 | 1.0 |
| Transmissibility[3] | 59. | 90–95 |
| Delivered Specific Impulse (Ispd) | 242. | 240. |
| Ispt | 251.4 | 254. |
| Pressure Exponent | 0.62–0.71 | 0.3–0.35 |
| Burning Rate | 0.4–0.85 | 0.5 |

[1] 1,2,3-tris[1,2-bis(difluoroaminoethoxy]propane
[2] 4,5-epoxycyclohexylmethyl 4',5'-epoxycyclohexylcarboxylate
[3] ARP served as the reference for transmissibility with a value of 56.

TABLE II

COMPARISON OF THE PRESSURE-BURNING RATE CHARACTERISTICS OF PROPELLANTS WITH AND WITHOUT A POLYNITROAROMATIC ADDITIVE
As illustrated in Table I

| PRESSURE (Kpsia) | BURNING RATE (in/sec) COMPOSITION A RH-U-106 | COMPOSITION B |
|---|---|---|
| 0.3 | 0.32 | 0.37 |
| 0.5 | 0.35 | 0.39 |
| 1.0 | 0.4 | 0.42 |
| 1.3 | 0.6 | 0.42 |

TABLE II-continued

COMPARISON OF THE PRESSURE-BURNING RATE CHARACTERISTICS OF PROPELLANTS WITH AND WITHOUT A POLYNITROAROMATIC ADDITIVE
As illustrated in Table I

| PRESSURE (Kpsia) | BURNING RATE (in/sec) COMPOSITION A RH-U-106 | COMPOSITION B |
|---|---|---|
| 2.1 | 1.3 | 0.44 |
| 3.9 | 3.6 | 0.51 |
| 7.0 | 5.2 | 0.83 |
| 10.4 | 6.8 | 1.9 |

The single FIGURE of the drawing illustrates in graph form the data on Table II, and clearly points out the effectiveness of applicant's pressure exponent suppressants.

The plasticizer and binder used with the pressure exponent depressants may be other than those illustrated in the propellant formulations set forth in Table I. With the prepolymer binder mix of acrylate to acrylic acid, it is preferred that a ratio of acrylate-to-acrylic acid of 95/5 be used, but the ratio of selected acrylate-to-acrylic acid in the prepolymer may vary from about 90/10 to about 96/4. The acrylate used may be selected for example from methyl acrylate, ethyl acrylate, 2-ethylhexyl acrylate, petrin acrylate, butyl acrylate, etc.

The plasticizer ingredient, TVOPA, used in the example of this invention is present with the prepolymer of acrylate to acrylic acid in a preferred ratio of about 5 to 1, and this ratio may vary from about 3 to 1 to about 6 to 1 when the two are used together. The amount of plasticizer present in the propellant formulation is preferably about 20 to 35 weight percent, but may vary from 0 to 40 weight percent.

TVOPA may be synthesized by reacting 1,2,3-tris(-vinoxy)propane (prepared in accordance with U.S. Pat. No. 2,969,400) with tetrafluorohydrazine. TVOPA contains two high energy difluoroamino groups, $NF_2$, added to each of the three vinoxy group of the starting compound, 1,2,3-tris(vinoxy)propane. The reaction of tetrafluorohydrazine with tris(vinoxy)propane to form TVOPA is conducted under pressures in the range of 10 psig up to about 600 psig, and temperature ranges of about 0°C. to 120°C. The reaction is carried out in an inert, volatile, organic solvent, preferably one that is a suitable common solvent for both the TVOPA as well as the reactants. Aromatic and aliphatic hydrocarbons, chlorinated hydrocarbons, ethers and ketones may be employed as the solvent. Typical solvents include diethyl ether, dipropyl ether, pentane, hexane, chloroform, carbon tetrachloride, methylene chloride, benzene, toluene, xylene, and acetone.

Even though the oxidizers, ammonium perchlorate and HMX, have been illustrated in the propellant formulations of Table I, other suitable organic and/or inorganic oxidizers may be used with the NF-propellant formulations or the other more conventional propellant formulations to which reference is made. For example, other oxidizers may include inorganic oxidizing salts which readily give up oxygen, such as, ammonium nitrate, potassium nitrate, potassium chlorate, lithium perchlorate, lithium chlorate, calcium nitrate, calcium chlorate, barium perchlorate, strontium chlorate, strontium perchlorate, etc. In addition organic oxidizers that are compatible with the propellant ingredients may also be used, as desired, in this application.

The propellant formulations illustrated contain no metal, but powdered metals such as aluminum, magnesium, titanium, zirconium, boron, etc. can be used in propellant formulations as needed or desired. Also, alloys and mixtures of the above listed metals can be employed, if desired.

Conventional curing agents such as UNOX 221, etc. may be used to cure the binder. Other additives, with or without carbon black in trace amounts, as desired, for the particular propellant may be used such as stabilizers, ballistic modifiers, processing aids and the like.

Even though the pressure exponent suppressants have been illustrated in relation to an inert-NF propellant formulation, the pressure exponent suppressants may be used in propellant formulations containing no NF groups or TVOPA in the formulations. That is, any propellant formulation that has a higher than desired pressure exponent can have one or more of the polynitrosubstituted aromatic compounds added thereto to lower the pressure exponent thereof. Of course, the pressure exponent suppressant must be compatible with the other propellant ingredients.

The techniques for preparing and formulating propellant compositions of the type referred to herein is well known to those skilled in the art since the pressure exponent suppressant is either incorporated as an addition to a propellant formulation or as a substitute for other propellant ingredients, as in the case of the NF-propellant formulations.

I claim:

1. A propellant composition comprising; a binder present in an amount of about 4 to about 20 weight percent, an oxidizer present in an amount of about 50 to about 80 weight percent, a pressure exponent suppressant selected from the group consisting of hexanitrostilbene, triaminotrinitrobenzene, picric acid and the ammonium salt of picric acid and a curing agent, said pressure exponent suppressant being present in an amount of about 1 to about 20 weight percent of the propellant composition.

2. The propellant composition of claim 1, wherein said oxidizer includes an inorganic oxidizer.

3. The propellant composition of claim 1, wherein said composition additionally contains a plasticizer present in an amount of about 20 to about 35 weight percent.

4. The propellant composition of claim 3, wherein said binder is an acrylate-acrylic acid copolymer, said oxidizer includes the oxidizing ingredient cyclotetramethylenetetranitroamine, and said pressure exponent suppressant is hexanitrostilbene.

5. The propellant composition of claim 4 wherein said composition additionally contains the oxidizer-ammonium perchlorate.

6. The propellant composition of claim 4, wherein said composition further contains the additive-carbon black.

7. The propellant composition of claim 4, wherein said cyclotetramethylenetetranitroamine is present in an amount of about 50 weight percent of said composition; said binder is present in an amount of about 5 weight percent of said composition; said plasticizer is present in an amount of about 25 weight percent of said composition; and said pressure exponent suppressant is present in an amount of about 20 weight percent of said propellant composition.

8. The propellant composition of claim 7, wherein said composition contains the additional ingredients carbon black, and said carbon black and curing agent are present in said composition as additives to all the other composition ingredients, said carbon black being present in an amount of about 0.5 weight percent and said curing agent being present in an amount of about 1.0 weight percent.

9. The propellant composition of claim 8, wherein said curing agent is 4,5-epoxycyclohexylmethyl 4′,5′-epoxycyclohexylcarboxylate.

10. The propellant composition of claim 1, wherein said pressure exponent suppressant is incorporated in said composition in an amount of about 1 to 5 weight percent.

* * * * *